US008826965B2

(12) United States Patent
Kim et al.

(10) Patent No.: US 8,826,965 B2
(45) Date of Patent: Sep. 9, 2014

(54) HIGH-VACUUM DIE-CASTING METHOD

(71) Applicant: Dongnam Precision Co., Ltd., Ulsan (KR)

(72) Inventors: Yong Hyun Kim, Ulsan (KR); Deak Soo Kim, Incheon (KR); Joo Yul Park, Ulsan (KR)

(73) Assignee: Dongnam Precision Co., Ltd., Ulsan (KR)

( * ) Notice: Subject to any disclaimer, the term of this patent is extended or adjusted under 35 U.S.C. 154(b) by 0 days.

(21) Appl. No.: 13/850,350

(22) Filed: Mar. 26, 2013

(65) Prior Publication Data

US 2013/0255901 A1 Oct. 3, 2013

(30) Foreign Application Priority Data

| | | |
|---|---|---|
| Apr. 2, 2012 | (KR) | 10-2012-0034104 |
| Apr. 2, 2012 | (KR) | 10-2012-0034105 |
| Apr. 2, 2012 | (KR) | 10-2012-0034106 |
| Apr. 2, 2012 | (KR) | 10-2012-0034107 |
| Apr. 2, 2012 | (KR) | 10-2012-0034108 |
| Apr. 2, 2012 | (KR) | 10-2012-0034109 |
| Apr. 2, 2012 | (KR) | 10-2012-0034110 |
| Apr. 2, 2012 | (KR) | 10-2012-0034111 |
| Apr. 2, 2012 | (KR) | 10-2012-0034112 |
| Apr. 2, 2012 | (KR) | 10-2012-0034113 |

(51) Int. Cl.

| | |
|---|---|
| ***B22D 27/15*** | (2006.01) |
| ***B22D 17/04*** | (2006.01) |
| ***B22D 17/14*** | (2006.01) |
| ***B22D 18/06*** | (2006.01) |
| ***B22D 17/22*** | (2006.01) |

(52) U.S. Cl.

CPC ..... *B22D 18/06* (2013.01); *B22D 17/14* (2013.01); *B22D 17/22* (2013.01)

USPC ..... 164/63; 164/65; 164/312

(58) Field of Classification Search

USPC ..... 164/47, 61, 63, 65, 113, 312

See application file for complete search history.

(56) References Cited

FOREIGN PATENT DOCUMENTS

| | | |
|---|---|---|
| JP | 2004249334 | 9/2004 |
| JP | 2004322138 A | 11/2004 |
| JP | 2012020310 | 2/2012 |
| KR | 1020060047239 | 5/2006 |

OTHER PUBLICATIONS

English Machine Translation of JP-2004-249334.*

(Continued)

*Primary Examiner* — Kevin P Kerns
*Assistant Examiner* — Steven Ha
(74) *Attorney, Agent, or Firm* — Gesmer Updegrove LLP

(57) ABSTRACT

A high-vacuum die-casting method includes an injecting step of moving a plunger in a sleeve so that a molten metal fed to the sleeve is pushed by the plunger to be injected into a cavity formed by a fixed mold and a movable mold, a cavity vacuumizing step of vacuum absorbing a gas in the cavity to discharge the vacuum-absorbed gas to the outside through a first path, and a sealed space vacuumizing step of vacuum absorbing a gas in a sealed space in which an eject plate and one ends of eject pins are arranged to discharge the vacuum-absorbed gas to the outside through a second path while the injecting step is performed. The sealed space vacuumizing step is started prior to the cavity vacuumizing step.

6 Claims, 7 Drawing Sheets

(56) References Cited

OTHER PUBLICATIONS

Korean OA issued on Jun. 28, 2013 and English translation issued in connection with corresponding KR Application No. 10-2012-0034104.

KR Notice of Allowance mailed on Jan. 9, 2014 in connection with corresponding Korean Application No. 10-2012-0034112 and English translation thereof.

* cited by examiner

HIGH-VACUUM DIE-CASTING METHOD

CROSS-REFERENCE TO RELATED PATENT APPLICATION

This application claims the benefit of Korean Patent Application Nos. 10-2012-0034104, filed on Apr. 2, 2012, 10-2012-0034105, filed on Apr. 2, 2012, 10-2012-0034106, filed on Apr. 2, 2012, 10-2012-0034107, filed on Apr. 2, 2012, 10-2012-0034108, filed on Apr. 2, 2012, 10-2012-0034109, filed on Apr. 2, 2012, 10-2012-0034110, filed on Apr. 2, 2012, 10-2012-0034111, filed on Apr. 2, 2012, 10-2012-0034112, filed on Apr. 2, 2012, 10-2012-0034113, filed on Apr. 2, 2012, in the Korean Intellectual Property Office, the disclosures of which are incorporated herein in their entirety by reference.

BACKGROUND OF THE INVENTION

1. Field of the Invention

The present invention relates to a high-vacuum die-casting method, and more particularly, to a high-vacuum die-casting method capable of efficiently discharging a gas in a cavity while a molten metal is injected into the cavity in which a metal product is to be molded.

2. Description of the Related Art

A die-casting method used for mass producing metal products commonly includes a series of processes of keeping a movable mold in contact with a fixed mold so that a cavity in which a metal product is to be molded is formed, injecting a molten metal into the cavity so that the molten metal is filled in the cavity, and, when the molten metal filled in the cavity is hardened into a metal product, separating the movable mold from the fixed mold and having an eject plate provided on a rear surface (an opposite surface to a surface that faces the fixed mold) of the movable mold approach the movable mold so that the metal product is ejected from the movable mold by eject pins fixed to the eject plate. While the molten metal is injected into the cavity, when a gas (air or a gas obtained by pyrolyzing a release agent) that exists in the cavity or a gas injected into the cavity with the molten metal is not discharged to the outside but mixes with the molten metal, incomplete filling defects such as porosities and pin holes are generated in the metal product so that the strength of the metal product is deteriorated and, in a case where the metal product is welded to another product, welding quality is deteriorated.

Therefore, when a metal product in which an amount of the gas mixed with the molten metal in the cavity must be extremely small, for example, an aluminum product that must have high tensile strength, high yield strength, and high elongation and that must be welded to other parts such as an aluminum front pillar (referred to as an A pillar) and a shock-absorber case used for a vehicle is die-casted, a method of vacuum absorbing the gas that exists in the cavity and the gas that flowed into the cavity with the molten metal to discharge the vacuum-absorbed gases to the outside so that the molten metal is injected while maintaining the cavity to be vacuous is used. When only the gases (the gas that exists in the cavity and the gas that flowed into the cavity with the molten metal) in the cavity are vacuum absorbed to be discharged to the outside, it is difficult to prevent a gas on a side of the eject plate from flowing into the cavity through gaps between the eject pins and the movable mold by vacuum pressure formed in the cavity so that the above-described effect of discharging the gases in the cavity is deteriorated.

A known method to solve the above-described problems is a method of providing a cover on the rear surface of the movable mold so that a space in which the eject plate and one of the ends (the ends combined with the eject plate) of the eject pins are arranged is sealed up by the cover and, when the gases in the cavity are vacuum absorbed, simultaneously vacuum absorbing a gas in the space sealed up by the cover, and discharging the vacuum absorbed gas in the space sealed up by the cover to the outside through a different path from a discharge path of the gas in the cavity so that it is possible to prevent a gas outside the cavity from flowing into the cavity through the gaps between the eject pins and the movable mold.

In the method of simultaneously discharging the gases in the cavity and the gas in the sealed space, the gases in the cavity may be more smoothly discharged than in a method in which only the gases in the cavity are vacuum absorbed and the gas in the sealed space is not additionally vacuum absorbed. However, it is necessary to improve the efficiency of discharging the gases in the cavity.

SUMMARY OF THE INVENTION

The present invention provides a high-vacuum die-casting method capable of efficiently discharging a gas in a cavity when die casting is performed using a die-casting high-vacuum mold in which a gas in a space sealed up by a cover and the gas in the cavity is vacuum absorbed through different paths to be discharged to the outside in a process of injecting a molten metal into the cavity.

According to an aspect of the present invention, there is provided a high-vacuum die-casting method using a die-casting high-vacuum mold including a fixed mold and a movable mold kept in contact with each other to form a cavity, a pipe-shaped sleeve combined with the fixed mold and having a molten metal feeding hole, a plunger having a pressure surface and movably provided in the sleeve in a longitudinal direction of the sleeve, an eject plate arranged to move toward or away from the movable mold, a plurality of eject pins slidably inserted into the movable mold and having one of their ends fixed to the eject plate, and a cover provided in the movable mold to surround a space in which the eject plate and the one ends of the eject pins are arranged and to form a sealed space. The high-vacuum die-casting method includes keeping the movable mold in contact with the fixed mold to form the cavity and feeding a molten metal to the sleeve through the molten metal feeding hole, an injecting step of moving a plunger in the sleeve so that the molten metal fed to the sleeve is pushed by the pressure surface of the plunger to be injected into the cavity, a cavity vacuumizing step of vacuum absorbing a gas in the cavity to discharge the vacuum-absorbed gas to the outside through a first path, a sealed space vacuumizing step of vacuum absorbing a gas in the sealed space to discharge the vacuum-absorbed gas to the outside through a second path different from the first path while the injecting step is performed, and, after the molten metal injected into the cavity is hardened into a metal product, separating the movable mold from the fixed mold and moving the eject plate toward the movable mold to eject the metal product from the movable mold by the eject pins. The sealed space vacuumizing step is started prior to the cavity vacuumizing step.

In the high-vacuum die-casting method according to the present invention, since the gas in the sealed space is vacuum absorbed before vacuum absorbing the gas in the cavity so that a large amount of gas in the sealed space is previously discharged to the outside, a probability that the gas in the sealed space flows to the cavity is remarkably reduced so that a burden of the cavity vacuum tank for vacuum absorbing the gas in the cavity is reduced and that, although a vacuum tank of a smaller capacity is used as the cavity vacuum tank, the gas in the cavity may be efficiently discharged. Other effects that may be obtained by the high-vacuum die-casting method according to the present invention will be easily understood by following description.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
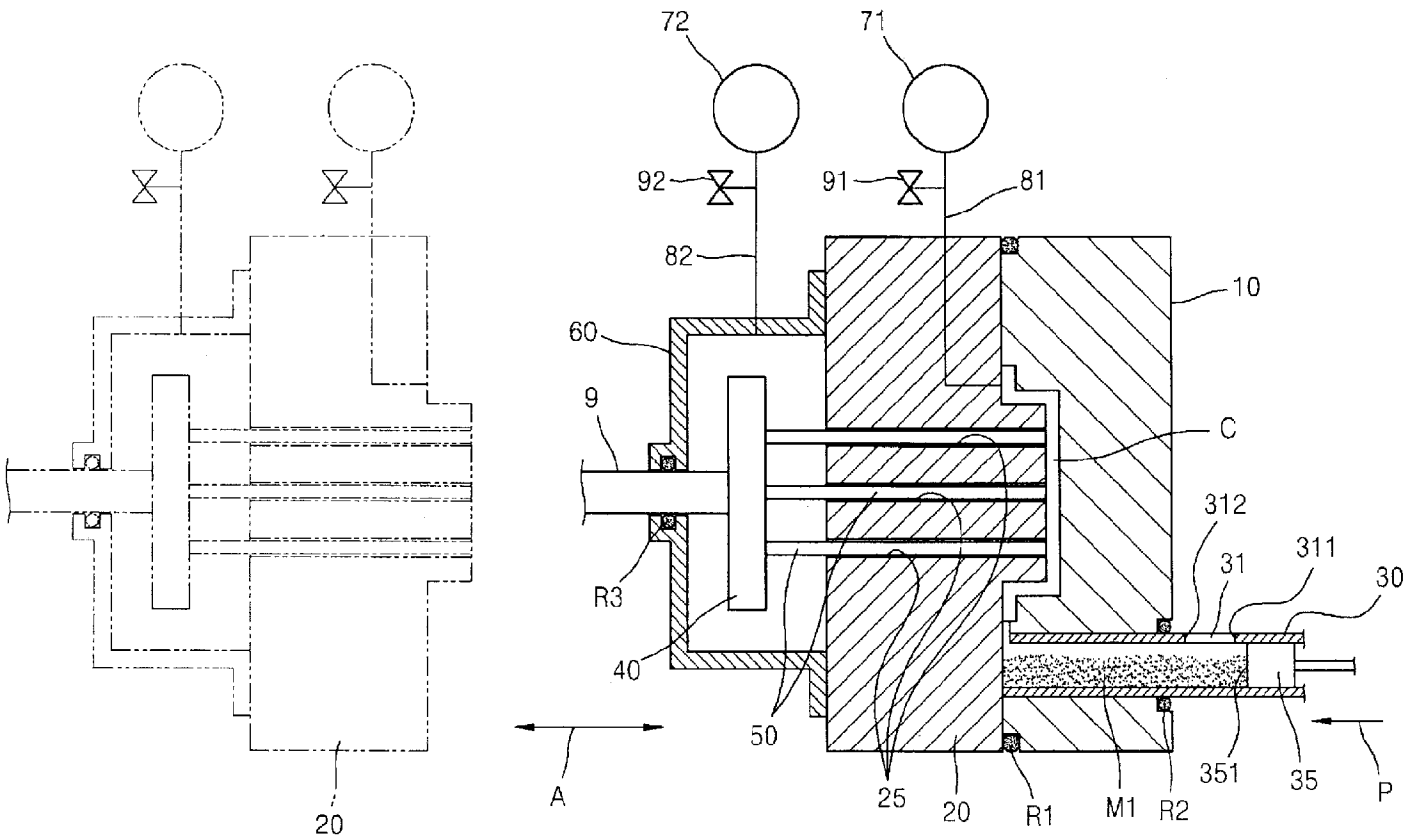
FIG. 1 is a schematic sectional view of an example of a die-casting high-vacuum mold used in a high-vacuum die-casting method according to an embodiment of the present invention.

Hereinafter, a high-vacuum die-casting method according to an embodiment of the present invention will be described in detail with reference to the accompanying drawings. FIG. 1 is a schematic sectional view of an example of a high-vacuum die-casting mold used in a high-vacuum die-casting method according to an embodiment of the present invention.

The high-vacuum die-casting mold includes a fixed mold 10, a movable mold 20, a pipe-shaped sleeve 30, a plunger 35 provided in the sleeve 30, an eject plate 40, a plurality of eject pins 50, and a cover 60.

The fixed mold 10 is fixed to a die-casting machine (not shown). The movable mold 20 is arranged in the die-casting machine to face the fixed mold 10. The movable mold 20 may be moved in a direction A to contact or separate from the fixed mold 10 by a driving source (not shown) such as a hydraulic ram. When the movable mold 20 is kept in contact with the fixed mold 10, a cavity C in which a metal product M (refer to FIG. 5) is to be molded is formed. One end of the sleeve 30 is inserted into and combined with the fixed mold 10 to communicate with the cavity C. A molten metal feeding hole 31 is formed at the top surface of the other end of the sleeve 30 in order to receive a molten metal M1 to be injected into the cavity C. The plunger 35 may be reciprocated, for example, by hydraulic power in a longitudinal direction of the sleeve 30. A front surface of the plunger 35 is a pressure surface 351 that contacts the molten metal M1 fed into the sleeve 30 and that pushes the molten metal M1 to inject the molten metal M1 into the cavity C. The eject plate 40 is arranged on a rear surface (an opposite surface to a surface that faces the fixed mold 10) of the movable mold 20 and is combined with a rod 9 reciprocated by hydraulic power to move toward or away from the movable mold 20 by the rod 9. The eject pins 50 are slidably inserted into through holes 25 of the movable mold 20. One of the ends of the eject pins 50 is fixed to the eject plate 40. The cover 60 is combined with the rear surface of the movable mold 20 by a fixing unit such as a screw. The cover 60 surrounds the eject plate 40 and one of the ends (the ends fixed to the eject plate 40) of the eject pins 50 and seals up a space in which the eject plate 40 and the one of the ends of the eject pins 50 are arranged to form a sealed space S. Reference numeral R1 denotes a seal ring for sealing up a gap between the fixed and moveable molds 10 and 20. Reference numeral R2 denotes a seal ring for sealing up a gap between the fixed mold 10 and the sleeve 30. Reference numeral R3 denotes a seal ring for sealing up a gap between the cover 60 and the rod 9.

For the high-vacuum die-casting mold, a first vacuum tank 71 is connected to the cavity C through a first path 81, and a second vacuum tank 72 is connected to the sealed space S through a second path 82 that is different from the first path 81. A first vacuum valve 91 for selectively opening or closing the first path 81 is connected to the first path 81. A second vacuum valve 92 for selectively opening or closing the second path 82 is connected to the second path 82. Solenoid valves may be properly used as the first and second vacuum valves 91 and 92. The first and second vacuum tanks 71 and 72 are maintained to be vacuous by a vacuum pump (not shown). When the first vacuum valve 91 is opened, a gas in the cavity C is vacuum absorbed by vacuum pressure of the first vacuum tank 71 to be discharged to the outside through the first path 81. When the second vacuum valve 92 is opened, a gas in the sealed space S is vacuum absorbed by vacuum pressure of the second vacuum tank 72 to be discharged to the outside through the second path 82.

Hereinafter, a high-vacuum die-casting method according to an embodiment of the present invention using the above-described die-casting high-vacuum mold will be described.

First, the movable mold 20 separated from the fixed mold 10 as illustrated in FIG. 1 by imaginary lines is kept in contact with the fixed mold 10 as illustrated in FIG. 1 by solid lines so that the cavity C is formed. Then, as illustrated in FIG. 1, in a state where the pressure surface 351 of the plunger 35 is positioned on an upstream side of the molten metal feeding hole 31 in an injecting direction P of the molten metal into the cavity C, the molten metal M1 is fed into the cavity C through the molten metal feeding hole 31.

In the present specification (including claims), "on an upstream side of the molten metal feeding hole 31 in injecting direction P of the molten metal" means "on an upstream side of an uppermost edge 311 of the molten metal feeding hole 31 in the injecting direction P of the molten metal" and "on a downstream side of the molten metal feeding hole 31 in the injecting direction P of the molten metal" means "on a downstream side of a lowermost edge 312 of the molten metal feeding hole 31 in the injecting direction P of the molten metal".

Figure 2:
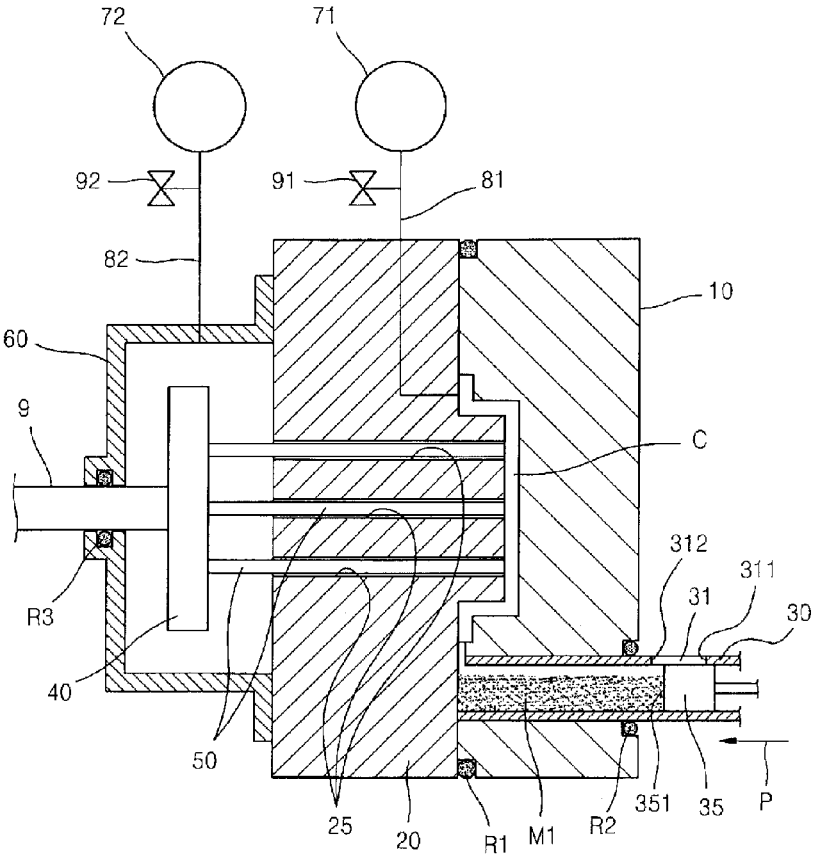
FIGS. 2 to 5 are views illustrating a process in which a plunger is moved in order to inject a molten metal in the sleeve illustrated in FIG. 1 into a cavity.
Figure 3:
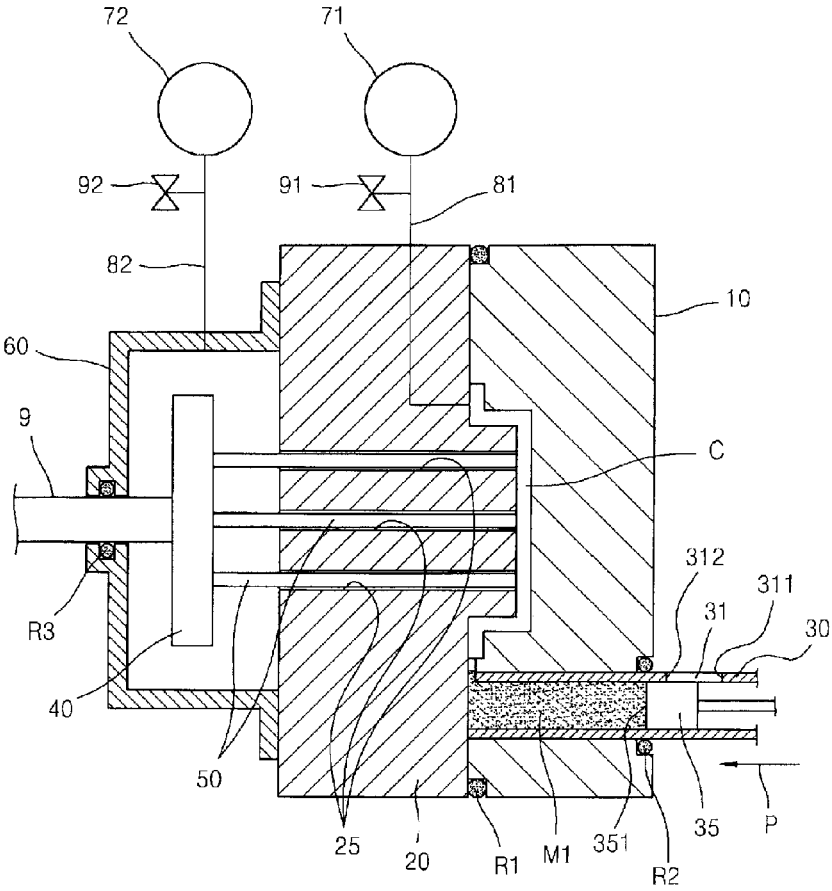
Figure 4:
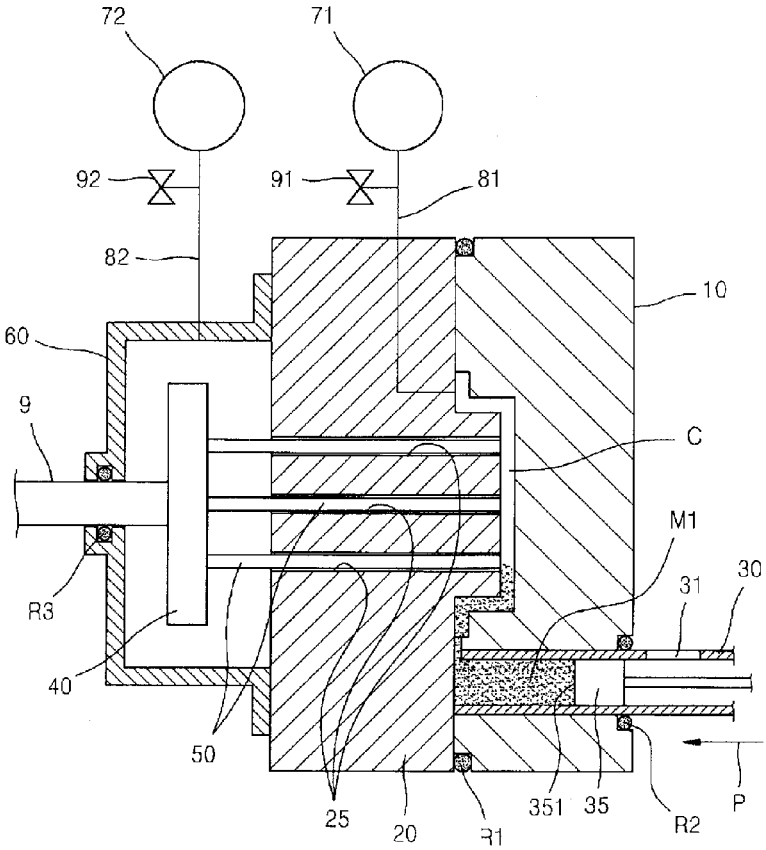
Figure 5:
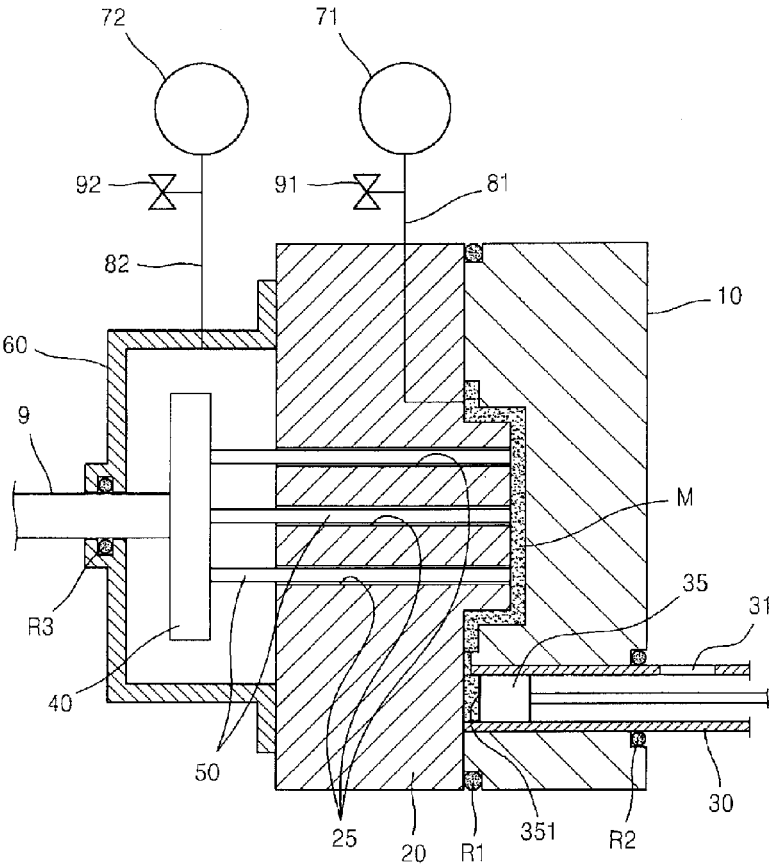

As described above, after the molten metal M1 is fed into the cavity C, an injecting step of moving the plunger 35 in the injecting direction P of the molten metal M1 so that the molten metal M1 in the sleeve 30 is pushed by the pressure surface 351 to be injected into the cavity C is performed. A starting point in time of the injecting step is a point in time at which the plunger 35 starts to move in the injecting direction P of the molten metal. An ending point in time of the injecting step is a point in time at which injection of the molten metal M1 into the cavity C is completed (filling of the molten metal M1 in the cavity C is completed) so that the plunger 35 stops as illustrated in FIG. 5. In a process where the plunger 35 is moved from the position illustrated in FIG. 1 in the injecting direction P of the molten metal, the pressure surface 351 of the plunger 35 passes by the uppermost edge 311 and the lowermost edge 312 of the molten metal feeding hole 31 to be moved to the downstream side of the molten metal feeding hole 31 in the injecting direction P of the molten metal M1 as illustrated in FIGS. 2 to 4 and stops at the point in time where the filling of the molten metal in the cavity C is completed as illustrated in FIG. 5.

Figure 6:
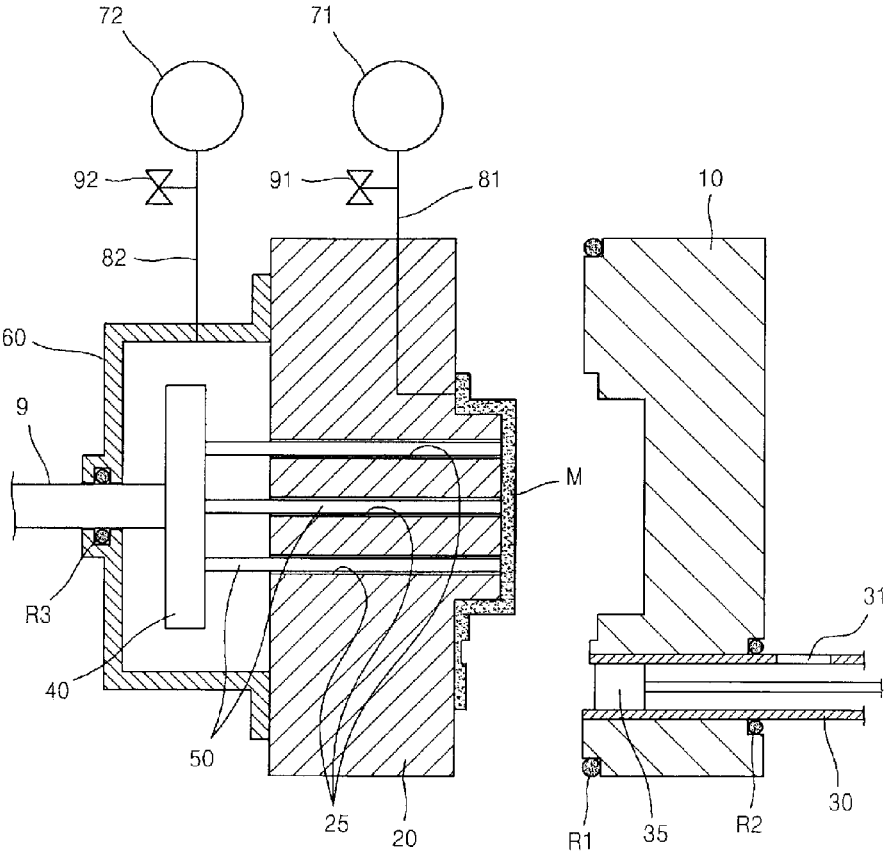
FIGS. 6 and 7 are views illustrating a process of discharging a molded metal product from the cavity illustrated in FIG. 1.
Figure 7:
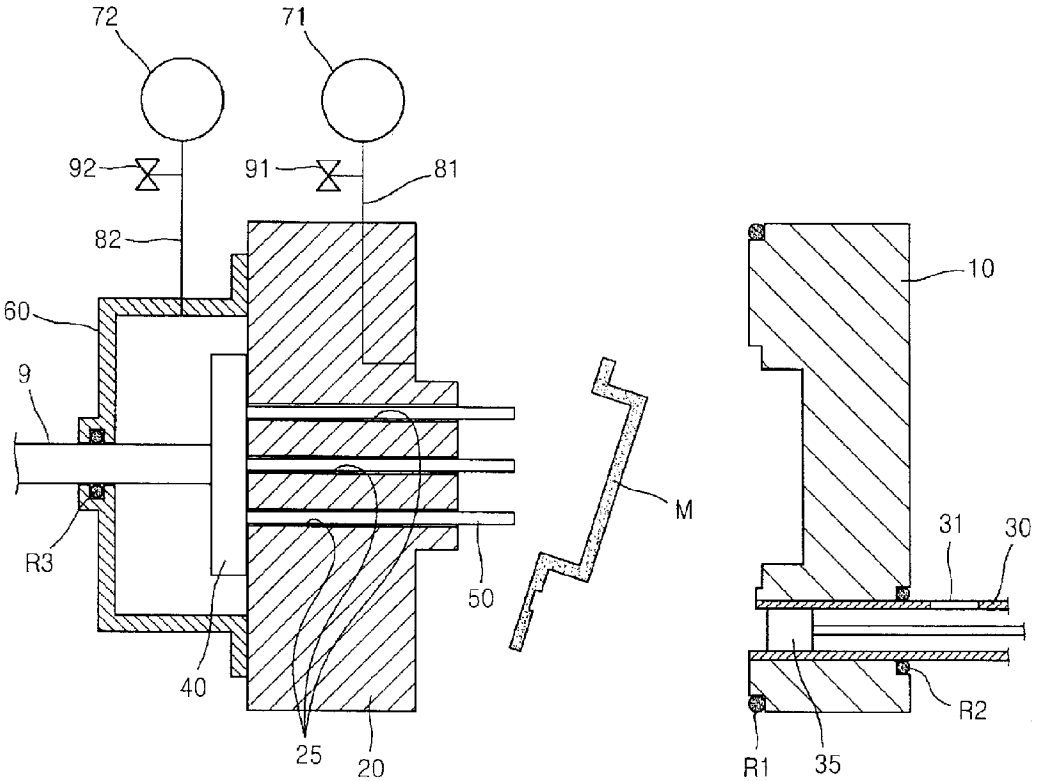

When a predetermined time passes after the injecting step is terminated, the molten metal filled in the cavity C is hardened into a metal product M of a shape corresponding to that of the cavity C. Then, when the movable mold 20 is separated from the fixed mold 10 as illustrated in FIG. 6 and the rod 9 and the eject plate 40 are moved toward the movable mold 20 as illustrated in FIG. 7, the eject pins 50 fixed to the eject plate 40 are moved together to eject the metal product M from the movable mold 20 and to separate the metal product M from the movable mold 20. When the metal product M is separated from the movable mold 20, a release agent is properly sprayed onto cavity surfaces (the surfaces that face each other) of the fixed and moveable molds 10 and 20, the eject plate 40 and the plunger 35 are restored to initial positions as illustrated in FIG. 1, and the movable mold 20 is kept in contact with the fixed mold 10. Then, metal product molding processes are repeated from the injecting step.

On the other hand, while the injecting step is performed, in order to prevent a gas from being mixed with the molten metal M1, a cavity vacuumizing step and a sealed space vacuumizing step are performed, which will be described in detail.

First, in the present embodiment, the injecting step includes a low-speed injecting step of moving the plunger 35 at a low speed and a high-speed injecting step of moving the plunger 35 at a higher speed than that in the low-speed injecting step.

In the cavity vacuumizing step, the first vacuum valve 91 is opened so that the gas in the cavity C is vacuum absorbed by the vacuum pressure of the first vacuum tank 71 to be discharged to the outside through the first path 81 and that the cavity C is vacuumized.

In the sealed space vacuumizing step, the second vacuum valve 92 is opened so that the gas in the sealed space S is vacuum absorbed by the vacuum pressure of the second vacuum tank 72 to be discharged to the outside through the second path 82 and thus the sealed space S is vacuumized.

The sealed space vacuumizing step starts prior to the cavity vacuumizing step. That is, the second vacuum valve 92 is opened prior to the first vacuum valve 91.

Concretely, the second vacuum valve 92 is opened when the pressure surface 351 of the plunger 35 is positioned on the downstream side of the molten metal feeding hole 31 in the injecting direction P of the molten metal into the cavity C as illustrated in FIG. 3 or is opened before the pressure surface 351 of the plunger 35 is positioned on the downstream side of the molten metal feeding hole 31 in the injecting direction P of the molten metal. "Before the pressure surface of the plunger is positioned on the downstream side of the molten metal feeding hole in the injecting direction of the molten metal into the cavity" means "before the pressure surface 351 of the plunger 35 passes by the lowermost edge 312 of the molten metal feeding hole 31 in the injecting direction P of the molten metal", for example, as illustrated in FIG. 1 or 2.

On the other hand, the first vacuum valve 91 is opened when the pressure surface 351 of the plunger 35 is positioned on the downstream side of the molten metal feeding hole 31 in the injecting direction P of the molten metal after the second vacuum valve 92 is opened. In the present embodiment, when the injecting step includes the low-speed injecting step and the high-speed injecting step, the first vacuum valve 91 is preferably opened before the low-speed injecting step is terminated. The cavity vacuumizing step starts by opening the first vacuum valve 91.

The cavity vacuumizing step starts when the pressure surface 351 of the plunger 35 is positioned on the downstream side of the molten metal feeding hole 31 in the injecting direction P of the molten metal so that a load of the first vacuum tank 71 or the vacuum pump is reduced.

Concretely, when the cavity vacuumizing step starts before the pressure surface 351 of the plunger 35 is positioned on the downstream side of the molten metal feeding hole 31 in the injecting direction P of the molten metal, while gases in the cavity C and the sleeve 30 are vacuum absorbed by vacuum absorption power of the first vacuum tank 71, an external gas (air) is absorbed into a space in which the molten metal M1 exists in the sleeve 30 through the molten metal feeding hole 31 and the newly absorbed gas must be vacuum absorbed by the first vacuum tank 71 so that the load of the first vacuum tank 71 increases.

However, when the cavity vacuumizing step starts when the pressure surface 351 of the plunger 35 is positioned on the downstream side of the molten metal feeding hole 31 in the injecting direction P of the molten metal, vacuum absorption is performed in a state where the molten metal feeding hole 31 is separated from the space in which the molten metal M1 exists in the sleeve 30 by the plunger 35. Therefore, when the gases in the cavity C and the sleeve 30 are vacuum absorbed, the external air is prevented from being absorbed through the molten metal feeding hole 31 so that the load of the first vacuum tank 71 is reduced. Therefore, although a vacuum tank with a smaller capacity than that of the vacuum tank required when the cavity vacuumizing step is started before the pressure surface 351 of the plunger 35 is positioned on the downstream side of the molten metal feeding hole 31 in the injecting direction P of the molten metal is used as the first vacuum tank 71, the gas in the cavity C may be efficiently discharged at a desired level.

On the other hand, since the second vacuum valve 92 is opened prior to the first vacuum valve 91, before the gas in the cavity C is vacuum absorbed into the first path 81, a large amount of gas in the sealed space S is previously discharged to the outside through the second path 82. Since the second vacuum valve 92 is continuously opened after the first vacuum valve 91 is opened, the sealed space S is maintained to be vacuous. Therefore, it is possible to effectively prevent the gas in the sealed space S from flowing into the cavity C through gaps between the eject pins 50 and the movable mold 20 while the cavity vacuumizing step is performed. For reference, in a process where the gas in the sealed space S is discharged to the outside through the second path 82 as described above, the gas in the cavity C flows to the sealed space S through the gaps between the eject pins 50 and the movable mold 20. However, when the gaps between the eject pins 50 and the movable mold 20 are narrow, the amount of gas in the cavity C that flowed through the gaps is not large. Therefore, although the sealed space vacuumizing step is started before the pressure surface 351 of the plunger 35 is positioned on the downstream side of the molten metal feeding hole 31 in the injecting direction P of the molten metal, the load of the second vacuum tank 72 generated by the gas that flowed from the cavity C to the sealed space S is not so large.

In addition, since the sealed space vacuumizing step is started by opening the second vacuum valve 92 before the cavity vacuumizing step is started as described above, while the injecting step is performed, a degree of vacuum in the sealed space S in the sealed space vacuumizing step may be maintained to be higher than that in the cavity C in the cavity vacuumizing step. In the present specification (including claims), "the degree of vacuum is low" means "it is high vacuum state" or "the pressure is low" and "the degree of vacuum is high" means "it is low vacuum state" or "the pressure is high". Although the degree of vacuum in the sealed space S in the sealed space vacuumizing step is maintained to be higher than that in the cavity C in the cavity vacuumizing step while the injecting step is performed, since a large amount of gas in the sealed space S is discharged to the outside through the second path 82 before starting the cavity vacuumizing step, it is possible to efficiently prevent the gas in the sealed space S from flowing into the cavity C through the gaps between the eject pins 50 and the movable mold 20.

Therefore, a vacuum tank with a smaller capacity than that of the second vacuum tank 72 required when the sealed space vacuumizing step is simultaneously started with the cavity vacuumizing step may be used as the second vacuum tank 72.

On the other hand, in relation to the degree of vacuum in the cavity C and the degree of vacuum in the sealed space S, when an aluminum front pillar or a shock-absorber case used for a vehicle is die-casted, the degree of vacuum in the cavity C is preferably maintained to be lower than 40 Torr and the degree of vacuum in the sealed space S is preferably maintained as 400 to 200 Torr. When the degree of vacuum in the cavity C is higher than 40 Torr, the above-described effect of preventing the gas from being mixed may be remarkably reduced. When the degree of vacuum in the sealed space S is higher than 400 Torr, it is difficult to effectively prevent the gas in the sealed space S from flowing into the cavity C through the gaps between the eject pins 50 and the movable mold 20 due to the degree of vacuum of the cavity C. When the degree of vacuum in the sealed space S is lower than 200 Torr, there is a high probability that the capacity of the second vacuum tank 72 must be unnecessarily increased. For reference, as the capacity of the vacuum tank increases, the price of the vacuum tank also increases. Although the capacity of the vacuum tank slightly increases, the cost of the vacuum tank remarkably increases. Therefore, when the capacity of the vacuum tank may be slightly reduced, the cost of the vacuum tank may be remarkably reduced.

As described above, when the injecting step is divided into a low-speed injecting step and a high-speed injecting step and the cavity vacuumizing step is started before the low-speed injecting step in which the plunger 35 is moved at a low speed is terminated, enough time to vacuum absorb the gas in the cavity C and the gas that exists in the sleeve 30 with the molten metal M1 and to discharge the vacuum-absorbed gases may be secured so that it is advantageous in discharging a desired amount of gas in the cavity C.

On the other hand, in relation to the low-speed injecting step and the high-speed injecting step, when the aluminium front pillar or the shock-absorber case used for a vehicle is die-casted, the movement speed of the plunger 35 in the low-speed injecting step is preferably 0.2 to 0.6 m/sec and the movement speed of the plunger 35 in the high-speed injecting step is preferably 2 to 4 m/sec. A point in time at which a switch from the low-speed injecting step to the high-speed injecting step is performed is set as a point in time at which the molten metal is partially injected into the cavity C, as illustrated in FIG. 4, preferably, a point in time at which the molten metal of about 15 to 35% of an entire volume of the cavity C is injected into the cavity C.

When the movement speed of the plunger 35 in the low-speed injecting step is lower than 0.2 m/sec, an entire cycle time may be too long. When the movement speed of the plunger 35 in the low-speed injecting step is higher than 0.6 m/sec, the effect of securing time to vacuum absorb the gas in the cavity may be reduced. When the movement speed of the plunger 35 in the high-speed injecting step is lower than 2 m/sec, it is disadvantageous in reducing the cycle time. When the movement speed of the plunger 35 in the high-speed injecting step is higher than 4 m/sec, the flow of the molten metal M1 is turbulent and the residing gas in the cavity C is not smoothly discharged so that a probability of generating incomplete filling defects may be increased. In addition, when the high-speed injecting step is started in a state where the volume of the molten metal that flowed to the cavity C is no more than 15% of the entire volume of the cavity C, the effect of securing the time to vacuum absorb the gas in the cavity C may be remarkably reduced. When the high-speed injecting step is started in a state where the volume of the molten metal that flowed to the cavity C is no less than 35% of the entire volume of the cavity C, the molten metal injected into the cavity C in the low-speed injecting step starts to harden so that a probability that the molten metal in the cavity C does not smoothly flow is high.

On the other hand, the cavity vacuumizing step is preferably terminated at the same time when the movement of the plunger for injecting the molten metal into the cavity is terminated (that is, the injecting step is terminated). In this case, the sealed space vacuumizing step may be terminated prior to the cavity vacuumizing step or may be terminated at the same time when the cavity vacuumizing step is terminated. When the cavity vacuumizing step and the sealed space vacuumizing step are continuously performed after the injecting step is terminated, a part of the molten metal in the cavity C is drawn to the first path 81 and the second path 82 by the vacuum absorption power of the first vacuum tank 71 and the second vacuum tank 72 so that a probability that burr is generated in the metal product molded in the cavity is high.

As described above, when the cavity vacuumizing step and the sealed space vacuumizing step are to be terminated at the same time when the injecting step is terminated, for example, a sensor (not shown) such as a touch sensor may be arranged in the cavity C (concretely, on the lowermost side based on the flow of the molten metal injected into the cavity) so that, when the molten metal is filled in the cavity to the lowermost side (that is, when the filling of the molten metal in the cavity is completed so that the injecting step is terminated), a filling completion state may be sensed by the sensor, and the first vacuum valve 91 and the second vacuum valve 92 may be closed based on a sensing signal. A point in time at which the cavity vacuumizing step and the sealed space vacuumizing step are terminated may be previously input to a controller (not shown) as time data, and the first and second vacuum valves 91 and 92 may be closed based on the time data at the corresponding point in time.

When the sealed space vacuumizing step is to be terminated prior to the cavity vacuumizing step, for example, the above-described sensor may be arranged slightly on the upstream side of the lowermost side based on the flow of the molten metal in the cavity so that the molten metal is sensed by the sensor before the molten metal is completely filled in the cavity, the second vacuum valve 92 is closed based on the sensing signal of the sensor, and the first vacuum valve 91 is closed at a point in time when a predetermined time (time spent until filling is completed) passes.

On the other hand, in relation to the point in times of the low-speed injecting step, the high-speed injecting step, the cavity vacuumizing step, and the sealed space vacuumizing step, the respective point in times may be previously input to the controller (not shown) as time data and the speed of the plunger 35 may be controlled or the respective vacuum valves 91 and 92 may be opened based on the time data at the corresponding point in time. Position sensing sensors (not shown) for sensing the position of the plunger 35 may be provided at proper positions and the speed of the plunger 35 may be controlled or the respective vacuum valves may be opened in accordance with a plunger position sensing signal of the position sensing sensors. Starting timings of the injecting steps and the vacuumizing steps may be controlled by other proper methods.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A high-vacuum die-casting method using a die-casting high-vacuum mold including a fixed mold and a movable mold kept in contact with each other to form a cavity, a pipe-shaped sleeve combined with the fixed mold and having a molten metal feeding hole, a plunger having a pressure surface and movably provided in the sleeve in a longitudinal direction of the sleeve, an eject plate arranged to move toward or away from the movable mold, a plurality of eject pins slidably inserted into the movable mold and having one of their ends fixed to the eject plate, and a cover provided in the movable mold to surround a space in which the eject plate and the one ends of the eject pins are arranged and to form a sealed space, the high-vacuum die-casting method comprising:

keeping the movable mold in contact with the fixed mold to form the cavity and feeding a molten metal to the sleeve through the molten metal feeding hole;

an injecting step of moving a plunger in the sleeve so that the molten metal fed to the sleeve is pushed by the pressure surface of the plunger to be injected into the cavity;

a cavity vacuumizing step of vacuum absorbing a gas in the cavity to discharge the vacuum-absorbed gas to the outside through a first path;

a sealed space vacuumizing step of vacuum absorbing a gas in the sealed space to discharge the vacuum-absorbed gas to the outside through a second path different from the first path while the injecting step is performed; and after the molten metal injected into the cavity is hardened into a metal product, separating the movable mold from the fixed mold and moving the eject plate toward the movable mold to eject the metal product from the movable mold by the eject pins, wherein the sealed space vacuumizing step is started prior to the cavity vacuumizing step, wherein the injecting step comprises a low-speed injecting step of moving the plunger at a low speed and a high-speed injecting step of moving the plunger at a higher speed than that in the low-speed injecting step after performing the low-seed injecting step, wherein the sealed s ace vacuumizin ste is started before the sressure surface of the plunger is positioned on the downstream side of the molten metal feeding hole in the injecting direction of the molten metal into the cavity, wherein the cavity vacuumizing step is started when the pressure surface of the plunger is positioned on a downstream side of the molten metal feeding hole in an injecting direction of the molten metal into the cavity and started before the low-speed injecting step is terminated, wherein the metal product is a front pillar of a vehicle, wherein a movement speed of the plunger in the low-speed injecting step is 0.2 to 0.6 m/sec, wherein a movement speed of the plunger in the high speed injecting step is 2 to 4 m/sec, and wherein a point in time at which a switch from the low-speed injecting step to the high-speed injecting step is performed is set as a point in time at which the molten metal of about 15 to 35% of an entire volume of the cavity is injected into the cavity.

2. The high-vacuum die-casting method as claimed in claim 1, wherein the cavity vacuumizing step is terminated when movement of the plunger for injecting the molten metal into the cavity is terminated, and wherein the sealed space vacuumizing step is terminated prior to the cavity vacuumizing step.

3. The high-vacuum die-casting method as claimed in claim 1, wherein the cavity vacuumizing step and the sealed space vacuumizing step are terminated when the movement of the plunger to inject the molten metal into the cavity is terminated.

4. The high-vacuum die-casting method as claimed in claim 1, wherein a degree of vacuum of the sealed space when the sealed space vacuumizing step is performed is maintained to be higher than that of the cavity when the cavity vacuumizing step is performed, and wherein the degree of vacuum of the cavity is maintained to be lower than 40 Torr and the degree of vacuum of the sealed space is maintained as 400 to 200 Torr.

5. The high-vacuum die-casting method as claimed in claim 2, wherein a degree of vacuum of the sealed space when the sealed space vacuumizing step is performed is maintained to be higher than that of the cavity when the cavity vacuumizing step is performed, and wherein the degree of vacuum of the cavity is maintained to be lower than 40 Torr and the degree of vacuum of the sealed space is maintained as 400 to 200 Torr.

6. The high-vacuum die-casting method as claimed in claim 3, wherein a degree of vacuum of the sealed space when the sealed space vacuumizing step is performed is maintained to be higher than that of the cavity when the cavity vacuumizing step is performed, and wherein the degree of vacuum of the cavity is maintained to be lower than 40 Torr and the degree of vacuum of the sealed space is maintained as 400 to 200 Torr.

* * * * *